US008303265B2

(12) United States Patent
Fronzoni

(10) Patent No.: US 8,303,265 B2
(45) Date of Patent: Nov. 6, 2012

(54) HYDRAULIC PUMP

(76) Inventor: Gian Carlo Fronzoni, Rapallo (IT)

( * ) Notice: Subject to any disclaimer, the term of this patent is extended or adjusted under 35 U.S.C. 154(b) by 714 days.

(21) Appl. No.: 12/307,427

(22) PCT Filed: Jul. 3, 2007

(86) PCT No.: PCT/EP2007/056694

§ 371 (c)(1),
(2), (4) Date: Jan. 5, 2009

(87) PCT Pub. No.: WO2008/003705

PCT Pub. Date: Jan. 10, 2008

(65) Prior Publication Data

US 2009/0317274 A1 Dec. 24, 2009

(30) Foreign Application Priority Data

Jul. 5, 2006 (IT) ..... GE2006A0071

(51) Int. Cl.
*F04B 49/00* (2006.01)

(52) U.S. Cl. ..... 417/307; 417/283; 251/51; 251/55

(58) Field of Classification Search ..... 417/283, 417/244, 288, 296, 303, 307–309, 437, 278, 417/279; 251/51, 55
See application file for complete search history.

(56) References Cited

U.S. PATENT DOCUMENTS

| | | | | |
|---|---|---|---|---|
| 3,033,119 | A | 5/1962 | Pschunder | |
| 3,357,363 | A * | 12/1967 | Raymond | 417/270 |
| 3,832,094 | A * | 8/1974 | Raymond | 417/222.1 |
| 6,453,719 | B1 | 9/2002 | Heskey et al. | |
| 7,316,287 | B2 | 1/2008 | Ohashi et al. | |
| 2005/0053478 | A1 | 3/2005 | Sakikawa et al. | |
| 2005/0226747 | A1 * | 10/2005 | Ohashi et al. | 417/434 |
| 2006/0104842 | A1 * | 5/2006 | Nozaki | 417/437 |

* cited by examiner

*Primary Examiner* — Anne Hines
*Assistant Examiner* — Jose M Diaz
(74) *Attorney, Agent, or Firm* — Stites & Harbison PLLC; Marvin Petry

(57) ABSTRACT

Axial piston hydraulic pump, comprising at least one piston (2), coupled by suitable transmission means (103, 113) to drive means (3) and slidable with a reciprocating motion inside a cylinder (101), the said cylinder (101) communicating with a fluid intake passage (151) and a fluid delivery passage (161, 301), one-way means (121, 501) of controlling the flow of the fluid being provided in both passages; the said delivery passage (301) communicates, downstream of the said one-way flow control means (501), with a constricted flow discharge member (401, 411, 431, 441).

19 Claims, 3 Drawing Sheets

HYDRAULIC PUMP

The present invention relates to a hydraulic pump, and specifically to a hydraulic piston pump.

The characteristics of a pump are essentially determined by the application for which it is intended, and consequently there are numerous different embodiments of these devices, designed to meet different requirements. In particular, the research which led to the present invention was conducted in the field of hydraulic pumps which are intended to deliver fluid at high pressures, up to several hundred atmospheres, and which are made with small dimensions, so that they can be used in easily transportable power controllers.

There are many problems associated with the construction of this kind of pump; in particular, it is important for the structure of the device to be extremely compact and light, so as to avoid negative effects on the volume and weight of the controller in which it is to be used. Clearly, the chosen type of construction must not have negative effects on essential characteristics such as safety and operating reliability.

Typically, a fundamental aspect of pumps used in portable controllers is the discharge from the circuits, since the pressures generated are very large and the pressure must be reduced very quickly in the circuit. This function is usually performed by a discharge valve included in the circuit, but this tends to have a negative effect on both the weight of the device and the complexity of construction of the circuit.

The object of the present invention is therefore to provide a hydraulic piston pump in which the discharge of the hydraulic circuit does not give rise to structural complications of the circuit or a significant increase in the volume and overall weight of the device.

The present invention therefore proposes an axial piston hydraulic pump comprising at least one piston, coupled by suitable transmission means to drive means and slidable with a reciprocating motion inside a cylinder, the said cylinder communicating with a fluid intake passage and a fluid delivery duct, one-way means of controlling the flow of the fluid being provided in both passages, characterized in that the said delivery passage communicates, downstream of the said one-way flow control means, with a constricted flow discharge member.

Further advantages and features of the device according to the present invention will be made clear by the following detailed description of an embodiment of the invention, provided, by way of example and without restrictive intent, with reference to the attached sheets of drawings, in which.

Figure 1:
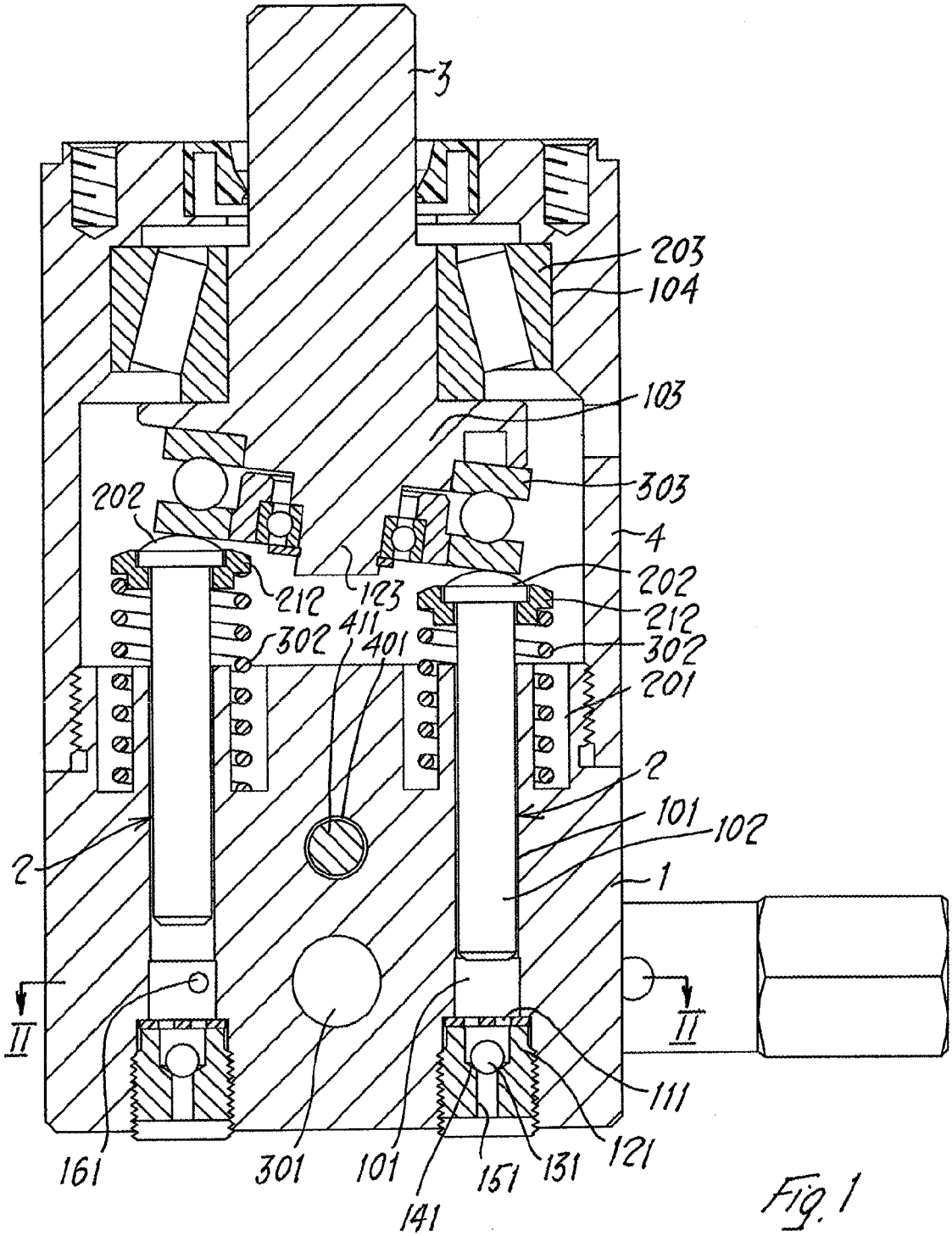
FIG. 1 is a sectional view of an embodiment of the pump according to the present invention.

FIG. 1 shows an embodiment of the pump according to the present invention; the number 1 indicates the body of the pump, in which the two cylindrical chambers 101 are formed. Each chamber 101 has an intake aperture 111 communicating with a passage 151 by means of a valve 121 comprising a seat 141 and a ball plug 131. The cylindrical chamber 101 also has a delivery channel 161, communicating with the delivery passage 301 in the way which is explained more fully below. Inside each cylindrical chamber 101 there is the rod 102 of a piston 2 which is slidable with a reciprocating motion, the end of the rod opposite the end inserted into the cavity 101 being provided with a mushroom-shaped head 202, which is in contact with the surface of the bearing 303 keyed on the inclined shaft 123 projecting from the plate 103 connected to the drive shaft 3. The said shaft 3 is mounted inside the cavity 104 of the cover 4 of the pump by means of the thrust bearing 203.

The head 202 of each piston 2 is inserted into an annular element 212 which interacts with a coil spring 302 placed in an annular groove 201 formed in the body 1 around each of the cylindrical cavities 101. The manifold 301 is formed in the body 1 between the two cavities 101, with its axis perpendicular to that of the said cavities; the passage 401, in which the plug 411 is located, is formed in a plane parallel to that in which the said manifold 301 lies.

Figure 2:
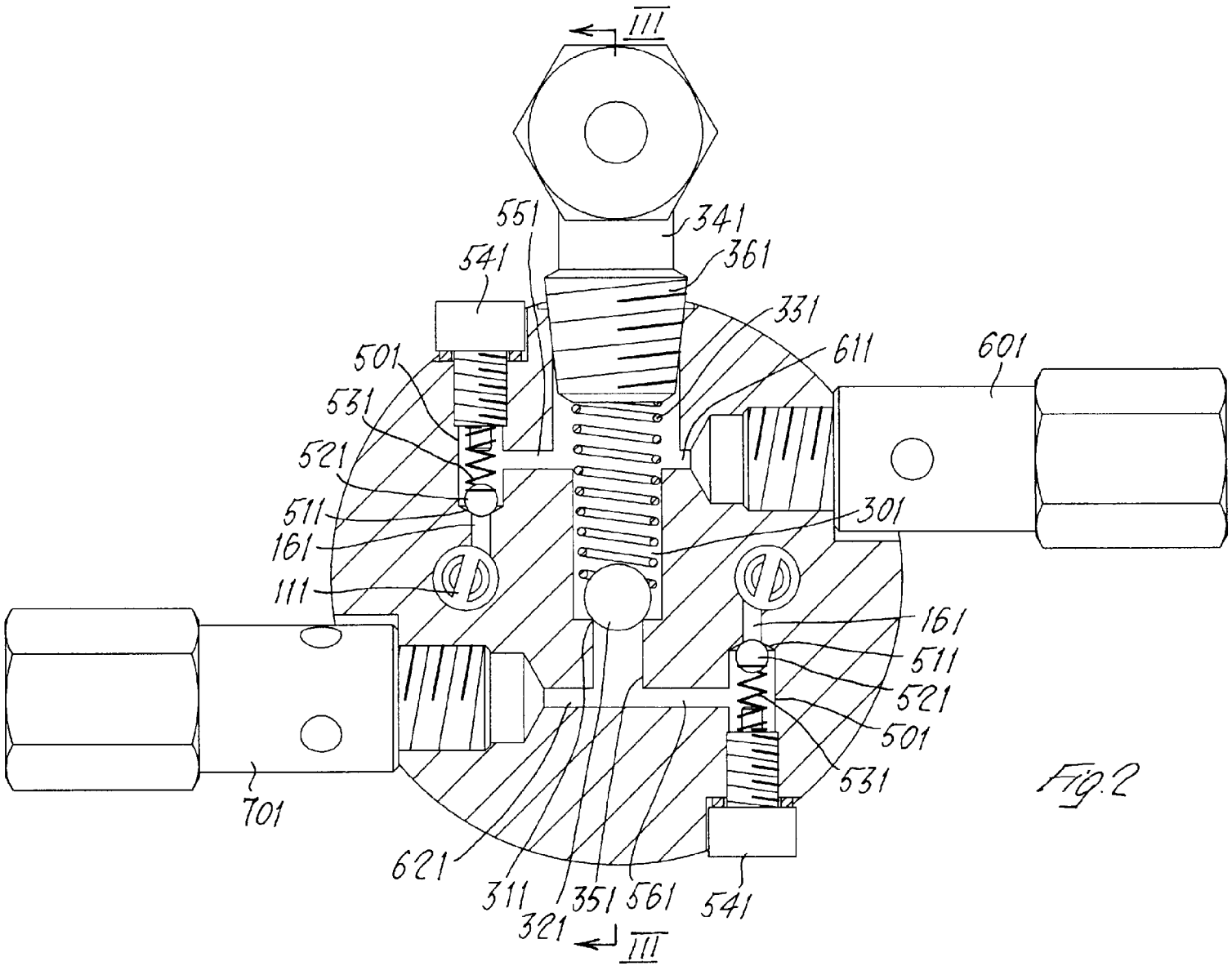
FIG. 2 is a view in cross section along the line II-II of FIG. 1.

In FIG. 2, the pump according to the invention is shown in section along the line II-II of FIG. 1; identical parts have been given identical numerals. The figure shows how both the cylinders 101 communicate with the intake apertures 111 and also with the delivery passages 161. In each delivery passage there is a non-return valve 501, which comprises a seat 511 in which is positioned a ball plug 521 loaded by a spring 531 whose opposite end bears on a bolt 541. In one case, the valve 501 communicates with a channel 551, which opens directly into the delivery manifold 301, while in the other case the valve 501 communicates with a channel 561 which opens into the passage 351, and the fluid reaches the delivery manifold through the non-return valve formed by the plug 321 loaded by the spring 331, whose opposite end bears on the threaded portion 361 of the joint 341 coupled to the said delivery manifold 301. A channel 611 communicating with a maximum pressure valve 601 opens into the delivery manifold 301; another maximum pressure valve 701 is connected to the channel 621 which opens into the passage 351.

Figure 3:
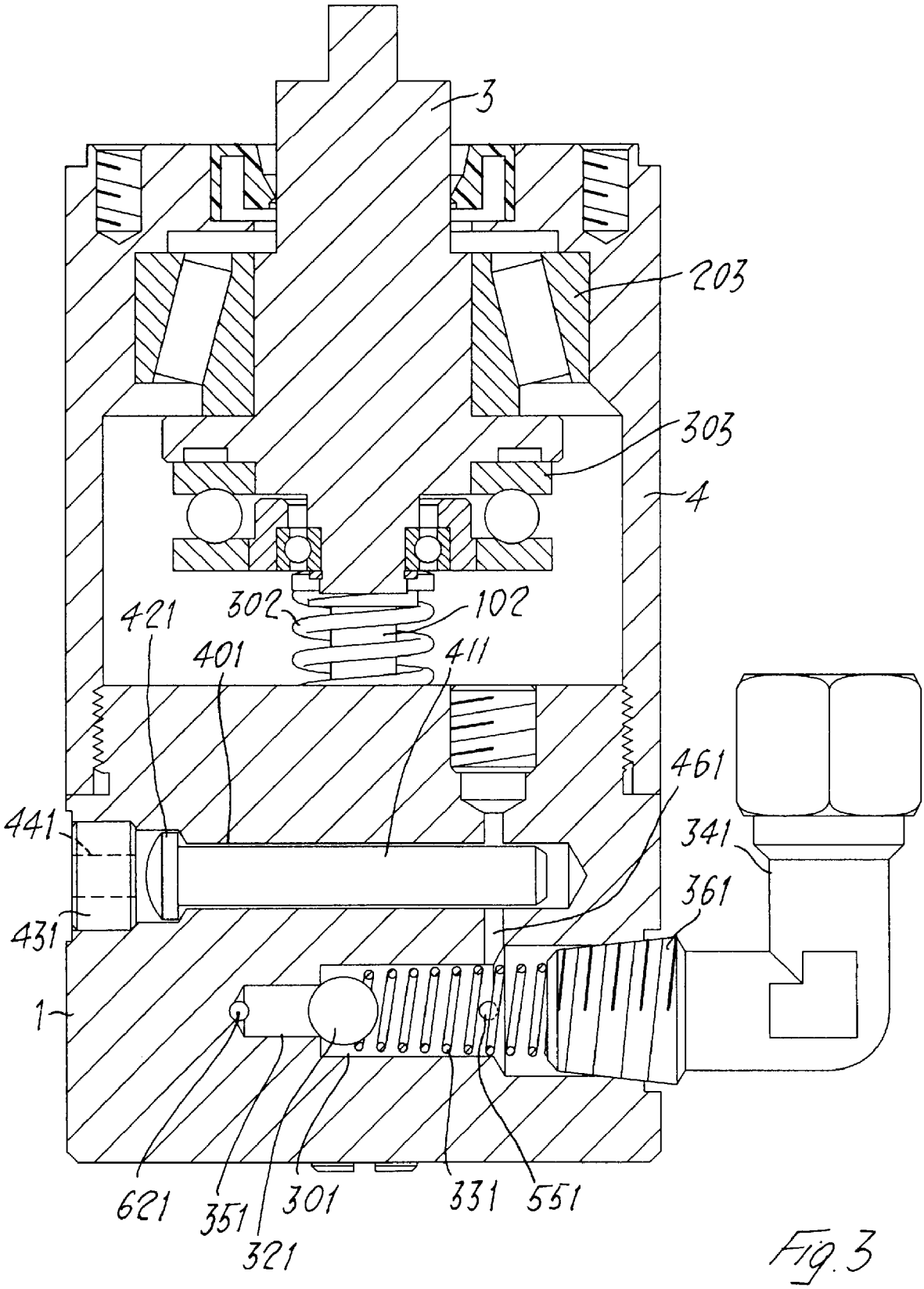
FIG. 3 is a sectional view along the line III-III of FIG. 2.

FIG. 3 is another sectional view of the pump according to the invention, along the line III-III of FIG. 2; identical parts have been given identical numerals. As can be seen, the delivery manifold 301 communicates, via a channel 461, with the passage 401 into which is introduced the plug 411, which in this case has the same proportions as the piston 2, and is provided with a mushroom-shaped head 421 like that of the piston; the passage is closed at the end facing the outside of the pump by a stopper 431 provided with the axial hole 441.

The operation of the pump according to the present invention will be made clear by the following description. The pump as shown in the figures described above is a pump which is immersed in an oil reservoir, from which the oil is drawn through the intake apertures 111 and the corresponding valves 121. When the motor is operated, the pressure in the circuit rises rapidly, due to the action of both pistons 2. When the set value of the valve 701 positioned in the circuit upstream of the non-return valve 321 of the delivery manifold 301 is reached, the portion of the circuit connected to the said valve goes into discharge mode, and the work of compression performed on the fluid is effectively carried out only by the piston which discharges through the passage 551 directly into the delivery manifold 301.

Thus very high pressures of about 1000 atmospheres can be achieved, with drive means of very limited power; the valve 701 is preferably set to discharge at a pressure in the range from 30 to 70 atmospheres, and preferably about 50 atmospheres. The motor that can be used in these conditions is a motor which can develop a power in the range from 500 to 1000 watts, and in particular a power of 750 watts. This makes it possible to use the pump with very small motors, and thus facilitates the use of the pump in transportable power controllers.

According to the principal innovative feature of the present invention, the decision was made to provide a constricted flow member for the discharge of the circuit when the motor is switched off, in order to lighten the system while also simplifying the hydraulic circuit. During the operation of the pump, the pressure drop due to the constricted flow of the oil in the intermediate space created between the plug 411 and the passage 401 is very small with respect to the operating pressure of the pump. However, when the motor is switched off, the fluid is rapidly discharged from the circuit, and the use of a substantially static member simplifies the construction of the circuit and avoids the introduction of an additional part which would make the device heavier.

The specific design of the constricted flow member makes it possible to achieve excellent safety margins in operation; this is because, whereas a constricted flow passage having a similar cross section to that used in the case illustrated herein would be subject to a high risk of clogging, the assembly of the passage 401 and the plug 411 provides better control of the constricted flow. Furthermore, the passage 401 is easily accessible, and its maintenance can be facilitated by the removal of the plug 411. Advantageously, the plug 411 is made to be entirely similar to the piston 2 used in each of the cylindrical chambers 101 of the pump; the result of this arrangement is that, during construction, the tool used to form the passage 401 and that used to form the cylindrical chambers are identical, and the process of forming the pistons 2 can also be used to form the appropriate plug used in the constricted flow member.

The pump designed in this way is highly efficient when used at high pressures, and particularly in equipment such as portable power controllers.

The invention claimed is:

1. An axial piston hydraulic pump, comprising at least one piston, coupled by a transmission to a drive mechanism and slidable with a reciprocating motion inside a cylinder, the cylinder communicating with a fluid intake passage and a fluid delivery passage, a one-way valve in each of said passages controlling the flow of the fluid therethrough, the delivery passage communicating with a delivery manifold positioned downstream of the one-way valve of the delivery passage, wherein the delivery manifold communicates with a constricted flow member which permits a fluid flow therethrough during operation of the pump at a flow rate which is very small relative to the operating pressure of the pump, the constricted flow member communicating at all times with a discharge aperture connected to atmosphere, wherein when the pump is shut off, continuation of the flow through the constricted flow member will cause the pressure in the pump to be rapidly reduced.

2. A pump according to claim 1, in which the constricted flow member comprises a further passage and an insert therein whose cross section is substantially complementary to the cross section of the further passage.

3. A pump according to claim 2, in which the shape and dimensions of the insert are substantially identical to the shape and dimensions of the piston.

4. A pump according to claim 1, in which the pump comprises a body of metallic material, in which the cylinder and the intake and delivery passages are formed, and in which the constricted flow member is positioned.

5. A pump according to claim 1, in which the delivery manifold is provided with a maximum pressure valve set to a given pressure level.

6. A pump according to claim 5, in which the pressure level is in the range from 500 to 1,000 atmospheres.

7. A pump according to claim 6, wherein the pressure level is about 720 atmospheres.

8. A pump according to claim 1, which comprises at least two pistons, each slidable with a reciprocating motion inside a cylinder, and in which the delivery manifold is provided with a non-return manifold valve, one of the two delivery passages being in communication with the delivery manifold downstream of the manifold valve, the other delivery passage communicating with a portion of the manifold upstream of the manifold valve, the portion of the delivery manifold located upstream from the manifold valve having a discharge valve set to a given pressure level.

9. A pump according to claim 8, in which the pressure level is in the range from 30 to 70 atmospheres.

10. A pump according to claim 9, wherein the pressure level is about 50 atmospheres.

11. A pump according to claim 9, including a maximum pressure valve which communicates with the delivery manifold downstream of the non-return manifold valve.

12. A pump according to claim 1, in which the transmission has a transmission shaft located on an axis, including an inclined plate placed at a given angle with respect to said axis and connected to the drive mechanism, the said axis being parallel to the axis of the cylinder.

13. A pump according to claim 1, wherein the further passage is cylindrical and communicates with the delivery manifold at one end and communicates at the other end with the discharge aperture.

14. A pump according to claim 13, including a cylindrical insert in the further passage, the insert having an outer diameter which is less than the diameter of the further passage by an amount sufficient to create a space therebetween for the constricted flow.

15. A pump according to claim 14, in which the shape and dimensions of the insert are substantially identical to the shape and dimensions of the piston.

16. An axial piston hydraulic pump, comprising at least one piston, coupled by a transmission to a drive mechanism and slidable with a reciprocating motion inside a cylinder, the cylinder communicating with a fluid intake passage and a fluid delivery passage, a one-way valve in each of said passages controlling the flow of the fluid therethrough, the delivery passage communicating with a delivery manifold positioned downstream of the one-way valve of the delivery passage, wherein the delivery manifold communicates with a constricted flow discharge member which is arranged to selectively discharge fluid to the atmosphere, the constricted flow discharge member comprising a further passage which is in communication with the delivery manifold at one end and provided with a discharge aperture for said selective discharge of fluid, and an insert located in the further passage and having a cross section which is substantially complementary to the cross section of the further passage, and wherein the shape and dimensions of the insert are substantially identical to the shape and dimensions of the piston.

17. A pump according to claim 16, which comprises at least two pistons, each slidable with a reciprocating motion inside a cylinder, and in which the delivery manifold is provided with a non-return manifold valve, one of the two delivery passages being in communication with the delivery manifold downstream of the manifold valve, the other delivery passage communicating with a portion of the manifold upstream of the manifold valve, the portion of the delivery manifold located upstream from the manifold valve having a discharge valve set to a given pressure level.

18. A pump according to claim 16, comprising at least two pistons, each slidable with reciprocating motion inside a cylinder.

19. A pump according to claim 17, in which the transmission has a transmission shaft located on an axis, including an inclined plate placed at a given angle with respect to said axis and connected to the drive mechanism, the said axis being parallel to the axis of the cylinder.

* * * * *